United States Patent [19]

Bolton et al.

[11] 3,932,157

[45] Jan. 13, 1976

[54] MEANS FOR MOUNTING A ROTATABLE LEVER IN A THIN WALL

[75] Inventors: Theodore S. Bolton; Burton F. Hammons, both of Liverpool, N.Y.

[73] Assignee: Carrier Corporation, Syracuse, N.Y.

[22] Filed: Oct. 25, 1974

[21] Appl. No.: 517,976

[52] U.S. Cl. ..... 62/408; 62/404; 62/427

[51] Int. Cl.[2] ..... F25D 17/04

[58] Field of Search ..... 62/410, 411, 412, 408, 62/409, 427

[56] References Cited

UNITED STATES PATENTS

| | | | |
|---|---|---|---|
| 2,769,320 | 11/1956 | Kuhlenschmidt | 62/427 |
| 3,194,028 | 7/1965 | Bell | 62/427 |
| 3,264,843 | 8/1966 | Ulich | 62/427 |
| 3,823,574 | 7/1974 | Bolton | 62/262 |
| 3,831,395 | 8/1974 | Levy | 62/427 |

*Primary Examiner*—William J. Wye

*Attorney, Agent, or Firm*—J. Raymond Curtin; Barry E. Deutsch

[57] ABSTRACT

A lever for operating a damper door of an air conditioner includes a rotatable shaft extending through an orifice of a wall in the air conditioner, the shaft having a pair of spaced collars for receiving therebetween the edges of the wall which define a slot receiving the lever. One collar is slightly bowed and has a tooth which engages an edge of the orifice to hold the lever in place in the wall when the shaft has been positioned in the slot.

2 Claims, 7 Drawing Figures

MEANS FOR MOUNTING A ROTATABLE LEVER IN A THIN WALL

BACKGROUND OF THE INVENTION

1. Field of the Invention

The present invention relates to means for mounting rotatble shafts in thin walls, and in particular to means for mounting a damper door operating lever in a wall of an air conditioning unit.

2. Description of the Prior Art

Air conditioning units such as room air conditioners generally include refrigeration circuits having an evaporator and a condenser. The unit is generally divided by a partition into an evaporator section and a condenser section. The unit is normally mounted with the evaporator section being adjacent the space being cooled by the unit and in communication with the air in that space, and the condenser section is in communication with outdoor air. Refrigerant flows through the refrigeration circuit and absorbs heat from the room air flowing through the evaporator section causing the refrigerant therein to evaporate and flow towards the condenser section. Refrigerant in the condenser section gives up absorbed heat to the outdoor air flowing over the condenser causing the refrigerant to condense. In addition to the capability of controlling the temperature of the air in the space being conditioned, it is often desirable to remove stale air from the space or to admit fresh, outdoor air to the space. This is accomplished in various air conditioning units by the provision of appropriately positioned ports in the foregoing partition which can be selectively opened and closed to control the flow of air between the evaporator and condenser sections. Although it is common to provide a port for exhaust air and a second port for ventilation air, it is entirely possible to provide but one of the foregoing ports.

Ports of the aforementioned type are usually located to make use of pressure differentials for forcing the air in the desired direction through the partition. Such pressure differentials are normally created by means of appropriate fans and blower wheels disposed in the respective sections. The use of such ports is known in the art, as evidenced by U.S. Pat. No. 2,986,016 which issued on May 30, 1961, to Gillham et al.

Damper doors are conventionally provided for selectively opening and closing exhaust and vent port doors in room air conditioners. An effective construction of damper doors of the foregoing type and the associated apparatus for selectively opening and closing the doors is disclosed in U.S. Pat. No. 3,823,574 which issued on July 6, 1974 to Theodore S. Bolton. The latter patent discloses a pair of pivotally mounted damper doors which are biased towards the closed positions by compression springs connected at one end to the partition and at the other end to one of the doors. The doors are opened by means of a lever which selectively engages the doors and overcomes the bias of the respective springs.

The lever provided by the foregoing patent comprises a rotatable shaft, an actuating arm extending from the shaft adapted to be positioned between tabs on the exhaust and vent doors of the air conditioning unit, and a control arm extending from the shaft and including a manually accessible portion. The shaft is selectively rotated by the control arm to cause the actuating arm to rotate the tab of either of the foregoing doors to open that door. Once the tab is disengaged from the door, springs bias the door to its closed position.

SUMMARY OF THE INVENTION

An object of the present invention is to mount a rotatable lever in a thin wall in a manner which facilitates the assembly of the lever in the wall.

A more particular object of the present invention is to provide means for mounting a damper door operating lever of an air conditioning unit in a wall of the unit in a manner which facilitates the assembly of the lever in the wall and is effective in maintaining the lever in the wall.

A further object of the present invention is to provide means for mounting a lever of the foregoing type which further facilitates the select removal of the lever from the wall.

Other objects will be apparent from the description to follow and from the appended claims.

The preferred embodiment of the invention described below provides an arrangement for mounting a damper door operating lever for a room air conditioner in a sheet metal wall of the air conditioner. The wall is provided with an orifice having a wide portion which is configured like a segment of a circle having a slot connected to the intersecting straight portions of the orifice. The lever includes a shaft having a pair of spaced collars, one of the collars being resilient and bowed towards the other collar to define therebetween a distance less than the thickness of the wall. The lever is assembled in the wall by passing one of the collars through the orifice and by sliding the portion of the shaft between the collars into the foregoing slot until the shaft abuts against the end of the slot. A tooth is provided on the bowed collar for engaging an edge of the wide portion of the orifice to retain the operating lever in position in the wall.

DESCRIPTION OF THE PREFERRED EMBODIMENT

The preferred embodiment of the invention provides an operating lever for controlling the opening of damper doors in air conditioning units such as exhaust and ventilation doors found in room air conditioning units. The preferred embodiment of the invention is described as incorporated in a room air conditioning unit having a ventilation door and an exhaust door covering ports in a wall or partition dividing the air conditioning unit into an evaporator section and a condenser section. The doors are presumed biased to their closed positions, and the operating lever described below selectively opens the doors upon the manual rotation of the lever.

Figure 1:
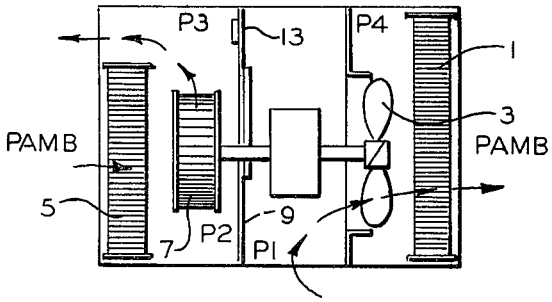
FIG. 1 is a pictorial representation of a portion of the interior of a room air conditioner showing damper doors over the vent and exhaust ports in a partition in the unit.

Referring now to FIG. 1, their is shown in schematic form a self-contained room air conditioning unit having appropriately placed exhaust and vent ports. The unit includes a condenser section in which are located a condenser 1 and a fan 3 for directing ambient air over the condenser coils as indicated by the arrow, and an evaporator section including an evaporator 5 and a blower wheel or other fan 7 for drawing room air over the evaporator coil and directing that air back into the room as indicated by the arrow. The two sections of the unit are separated and isolated by a partition or wall 9. The unit is adapted for installation in a room so that the evaporator section communicates with the room air while the condenser section communicates with the outdoor air. The condenser and evaporator are part of a conventional refrigeration circuit which also includes a compressor and an expansion device (not shown), with the evaporator serving to absorb heat from room air drawn over the evaporator coils by the blower which then returns the cooled air back into the room. The heat absorbed by the refrigerant in the evaporator is thereafter transferred to the air being blown across the condenser coils by fan 3. Partition 9 is located considerably closer to blower wheel 7 and to fan 3 so that the pressure $P_2$ in the region of blower wheel 7 is less than the pressure $P_1$ in the condenser side of partition 9. Both of the pressures $P_2$ and $P_1$ are suction pressures and thus below the ambient pressure $P_{AMB}$. The pressure $P_3$ above blower wheel 7 is higher than the ambient pressure and is also higher than the pressure $P_4$ above fan 3 because of the relative characteristics of the two air moving devices. An exhaust port 13 is defined in wall 9 between the region of pressure $P_3$ and the region of pressure $P_4$ so that when port 13 is open, air flows through the port into the condenser section. Similarly, a vent port 15 is defined in partition 9 between the region of pressure $P_2$ and the pressure $P_1$ so that when port 15 is opened, air flows from the condenser section into the evaporator section and thereafter into the room.

Figure 2:
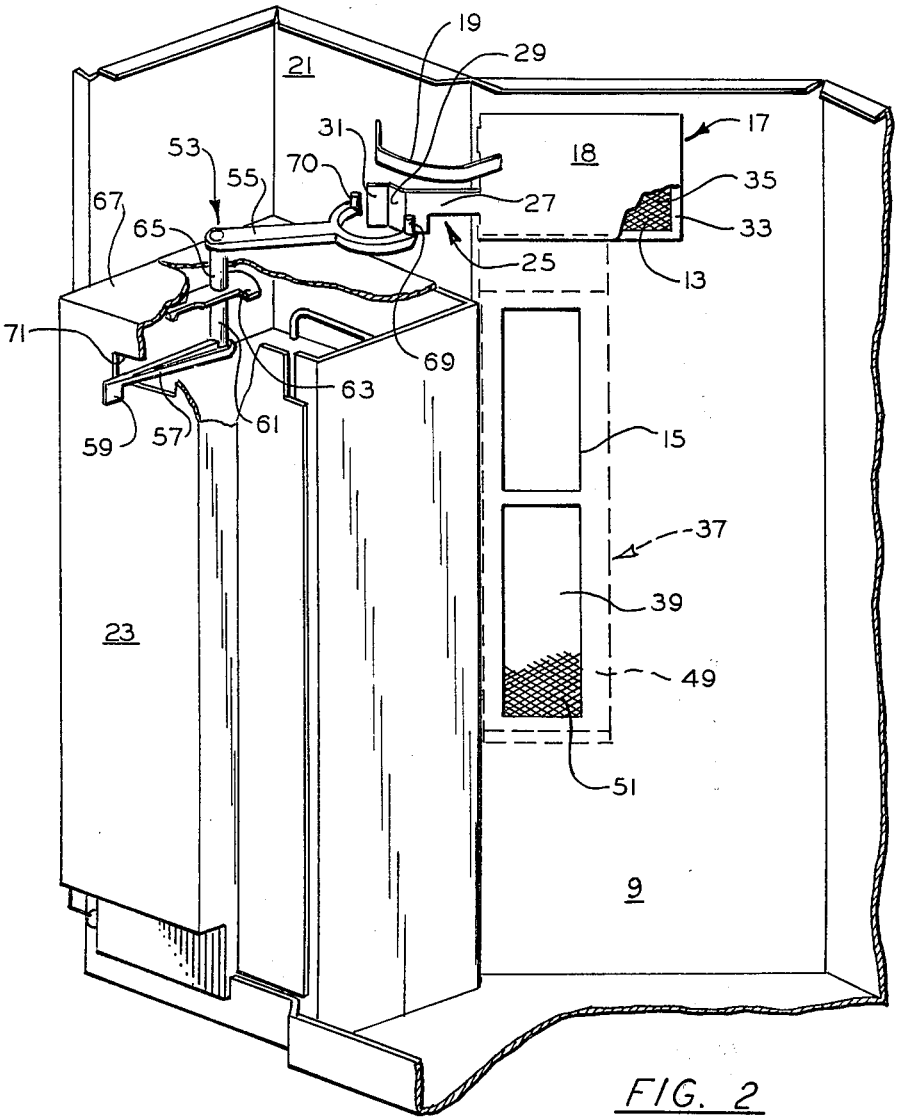
FIG. 2 is a perspective view of the interior portion of a room air conditioner incorporating the present invention.

FIG. 2 depicts apparatus for controlling the opening and closing of ports 13 and 15. The apparatus depicted enables the alternate opening of one of the ports and permits the closing of both ports; however, the apparatus is not adapted to open both ports simultaneously, since this would have the undesirable effect of simply circulating air between the ports rather than transferring air to and from the room being air conditioned. An exhaust port door 17 has a portion 18 configured to cover and close exhaust port 13 and is mounted for pivotal movement about an axis by a pair of tabs (not shown) extending through wall 9 adjacent port 13 and also adjacent the axis of rotation. Door 17 is spring biased to its closed position by an open-ended, overcenter leaf spring 19 connected at one end to door 17 and at its other end to wall 9 on the other side of the axis of rotation of the door. Spring 19 is of the type described in commonly-assigned, co-pending, U.S. patent application Ser. No. 517,795 filed Oct. 25, 1974. A portion 21 of wall 9 is configured to enable the air conditioning unit to accommodate a control box 23 which contains the operating buttons or the like for the unit. A tab 25 extends from door 18 across the axis of rotation of the door and includes a first section 27 which is coplanar with portion 18 of door 17, a second section 29 bent back transversely towards wall portion 21, and third section 31 which is generally parallel to section 27. The function of tab 25 will be apparent from the description to follow.

A gasket 33 fabricated from some suitable material such as urethane foam is advantageously applied to door portion 18 engaging the wall surface surrounding exhaust port 13 when the door is moved to its exhaust port closing position. The engagement of gasket 33 and the port edge enhances the degree to which the door seals the port against the passage of air. In order to prevent any material which could damage the air conditioning unit from passing through discharge port 13, a filter 35 can be affixed across the port. Filter 35 may comprise a common filtering material such as a fine mesh screen.

Vent port 15 is disposed between fan 3 and blower 7 to take advantage of the previously described pressure differential existing in this area. A vent port door 37 is mounted for pivotal movement to open and close vent port 15. Vent port door 37 includes a vent port closing portion 39 which is dimensioned to shut port 15 to the passage of air. Door 37 may include a tab similar to tab 25. Means are provided for biasing door 37 to its closed position, and it is contemplated that a spring similar or identical to spring 19 be connected to door 37 and partition 9 for this purpose in a manner similar to spring 19. However, for the sake of clarity, the provision of the tab and such biasing means has been omitted with regard to door 37. For the purposes of this description, it should be assumed that spring means are provided for biasing door 37 about an axis parallel to the axis of door 17 towards the vent port closing position. A gasket 49 fabricated from urethane foam or other appropriate material is attached to door 37 for engaging the wall surface around vent port 15 when door 37 is in its port closing position. A filter 51 such as the fine mesh screen mentioned previously is advantageously provided across vent port 15 for preventing potentially damaging materials from passing through the vent port.

In order to effect the selective opening and closing of the two ports, an operating lever 53 is provided in the unit. Lever 53 is preferably a unitary piece which can be fabricated from molded plastic, and comprises an actuating arm 55 engageable with tab 25 of door 17 and a control arm 57 having a manually engageable portion 59 for operating the lever. Arms 55 and 57 extend transversely from a rotatable shaft 61 having a longitudinal axis of rotation which is parallel to the axes of rotation of exhaust port door 17 and vent port door 37. A pair of spaced collars 63 and 65 also extend from shaft 61 and, as described below, are adapted to engage a wall 67 of control box 23 to mount operating lever 53 in the air conditioning unit.

Actuating arm 55 includes at its end portion furthermost spaced from shaft 61, a pair of cylindrical portions 69 and 70 which are engageable with tab 25 of exhaust door 17. Additionally, arm 55 may include a portion engageable with the actuating means for door 37. However, again for the sake of clarity, this provision has been omitted. Preferably, control arm 57 is angularly displaced from actuating arm 55 so that when the vent and exhaust doors are in their closed positions, manually engageable portion 59 is centrally disposed in a slot 71 in the exterior of control box 23. In other words, the foregoing elements are arranged so that when both doors are shut, control arm 57 is movable left or right as shown in FIG. 2. When both exhaust port door 17 and vent port door 37 are closed, cylindrical portions 69 and 70 of actuating arm 55 are in engagement with parallel section 27 of tab 25, as indicated in FIG. 2. When control arm 57 is moved counterclockwise or to the right as indicated in FIG. 2, a force is exerted transversely on section 27 of tab 25 of the exhaust door with the resulting torque causing door 17 to pivot about its axis to open exhaust port 13. When control arm 57 has been so moved to a predetermined extent, cylindrical portions 69 and 70 slide over section 29 onto section 31. When arm 57 is moved clockwise or to the left, cylindrical portions 69 and 70 are forced back onto section 27 and thereby exert a force on tab 25 to return door 17 to its closed position. The mechanism can be suitably designed so that rotation of arm 57 will cause door 37 to open when movement of the arm is in a clockwise direction and to close, when movement is in a counterclockwise direction.

Figure 3:
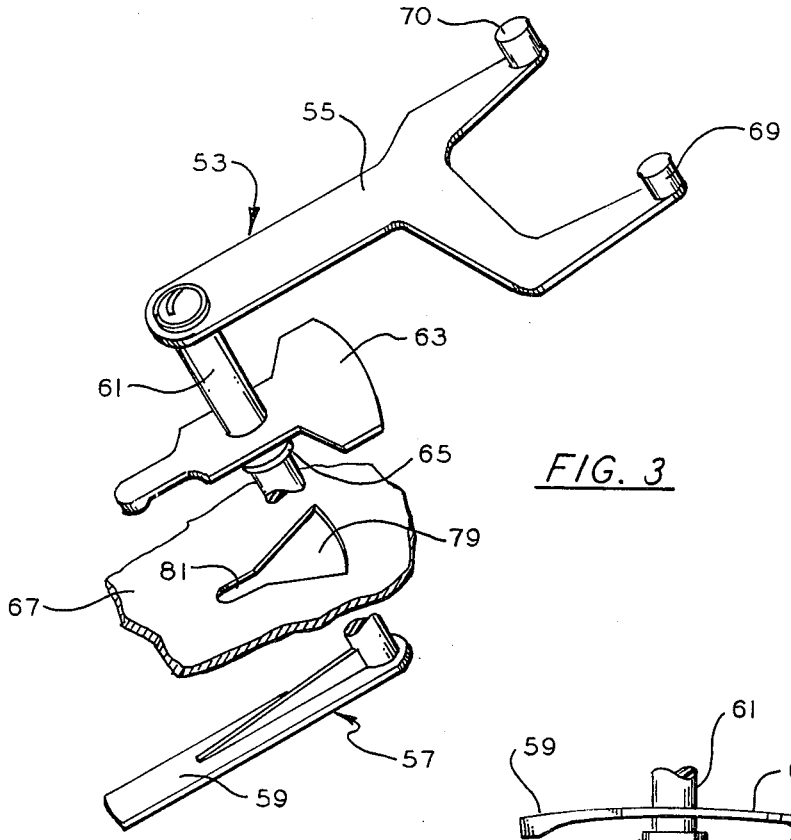
FIG. 3 is a detailed perspective drawing of a damper door operating lever according to the present invention and an associated portion of a wall in which such lever is to be assembled.
Figure 4:
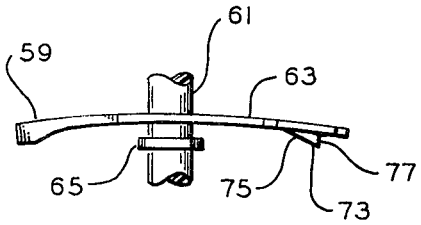
FIG. 4 is a side view of a portion of an operating lever according to the present invention.
Figure 5:
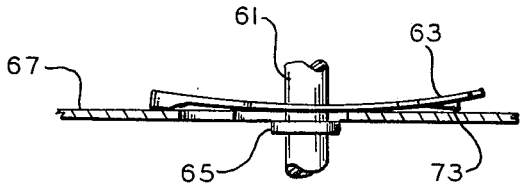
FIGS. 5 and 6 are side views of an operating lever according to the present invention in sequential stages of its assembly in a wall of the air conditioning unit in which it is being inserted.

FIGS. 3 through 7 indicate the construction provided for the assembly of operating lever 53 in the air conditioning unit. Collar 65 is a planar disc concentrically positioned on shaft 61. Collar 63 is spaced from collar 65 and is bowed towards collar 65 so as to be concave towards the latter collar. Collar 63 is resilient and is substantially larger than collar 65. A tooth 73 extends from collar 63 in the direction of collar 65 and has a beveled edge 75 and an abutment edge 77 which is substantially perpendicular to collar 63. As indicated in FIG. 5, the distance between the lowermost part of collar 63 and the plane of collar 65 is less than the thickness of wall 67. Wall 67 is provided with an orifice which, as shown in FIG. 3, includes a wide portion 79 which has the general configuration of the segment of a circle and has connected thereto a relatively narrow slot 81.

Figure 7:
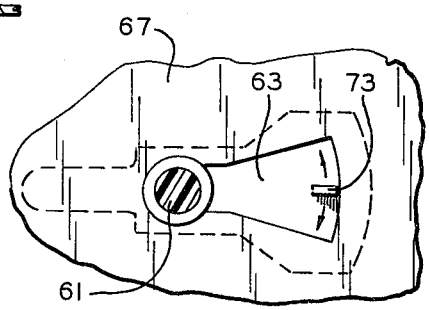
FIG. 7 is a view taken in a direction indicated by the arrow 7—7 in FIG. 6.
Figure 6:
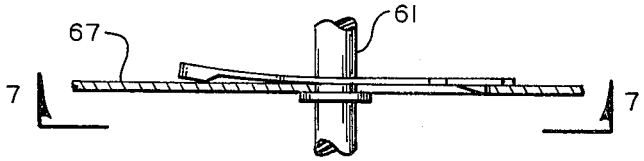

In order to assemble operating lever 53 in wall 67, the lever is inserted into the wide portion 79 of the orifice so that collar 65 is on one side of wall 67 and collar 63 is on the other side as shown in FIG. 5. In order to achieve this result, force must be exerted against collar 63 as indicated in FIG. 5 to reverse the direction of bowing of collar 63. Once the operating lever has been so inserted, a portion of shaft 61 between the two collars is moved into slot 81 until that portion of the shaft abuts against the end of slot 81 and tooth 73 drops into the wide portion 79 of the orifice as shown in FIG. 6. The tooth is positioned so that the latter occurrence, e.g. the engagement of shaft 61 with the edge of slot 81 and the dropping of tooth 73 into the orifice occur at the same time period. At this time, operating lever 53 is securely assembled in wall 67 and cannot be inadvertently removed. Now, operating lever 53 can be rotated as shown in FIG. 7 without danger of removal of the lever from wall 67. It should be understood, since the main function of tooth 73 is to maintain lever 53 locked in position relative to the orifice, the tooth can be placed on the top surface of wall 67 to engage the outer edge of collar 63 to achieve the same result.

While a preferred embodiment of the invention has been described and illustrated, the invention should not be limited thereto, but may be otherwise embodied within the scope of the following claims.

We claim:

1. The combination comprising:

a thin wall including an orifice having a wide portion connected to a narrow slot, said wall forming a part of the housing of an air conditioner, said air conditioner including a damper door mounted for pivotal movement to open and close a port; and a member mountable in said wall for rotation relative to said wall, said member including a shaft, and first and second collars on said shaft, said collars having opposing faces spaced to receive portions of said wall therebetween, one of said collars being resilient and bowed towards the other collar to reduce the distance between the opposed faces of said collars to an amount less than the thickness of said wall, said member further including an arm for engaging and pivoting said damper door in response to rotation of said member, said combination further including a projection to lock said member in place when the portion of said shaft between said collars is engaged with the end edge of said narrow slot.

2. The invention according to claim 1 wherein said projection extends from said one collar towards the plane of said other collar and is positioned to engage an edge of the wide portion of said orifice when said shaft portion is engaged with the end edge of said narrow slot.

* * * * *